US010337387B2

(12) United States Patent
Kuhlbach et al.

(10) Patent No.: US 10,337,387 B2
(45) Date of Patent: Jul. 2, 2019

(54) APPLIED-IGNITION, LIQUID-COOLED INTERNAL COMBUSTION ENGINE WITH COOLED CYLINDER HEAD

(71) Applicant: Ford Global Technologies, LLC, Dearborn, MI (US)

(72) Inventors: Kai Sebastian Kuhlbach, Bergisch Gladbach (DE); Joachim Hansen, Bergisch Gladbach (DE); Jan Mehring, Cologne (DE)

(73) Assignee: Ford Global Technologies, LLC, Dearborn, MI (US)

( * ) Notice: Subject to any disclaimer, the term of this patent is extended or adjusted under 35 U.S.C. 154(b) by 64 days.

(21) Appl. No.: 15/413,090

(22) Filed: Jan. 23, 2017

(65) Prior Publication Data

US 2017/0211457 A1 Jul. 27, 2017

(30) Foreign Application Priority Data

Jan. 27, 2016 (DE) ..... 10 2016 201 166

(51) Int. Cl.
*F01N 13/10* (2010.01)
*F02F 1/38* (2006.01)
(Continued)

(52) U.S. Cl.
CPC ..... *F01N 13/102* (2013.01); *F01P 3/02* (2013.01); *F02F 1/243* (2013.01); *F02F 1/38* (2013.01); *F02F 1/42* (2013.01); *F02F 1/4271* (2013.01); *F02F 11/00* (2013.01); *F01N 2510/02* (2013.01); *F01P 2003/024* (2013.01); *F02F 2001/4278* (2013.01)

(58) Field of Classification Search
CPC ..... F01N 13/102; F01N 2510/02; F02F 1/38; F02F 1/4271; F02F 1/243; F02F 1/42; F02F 11/00; F02F 2001/4278; F01P 3/02; F01P 2003/024
See application file for complete search history.

(56) References Cited

U.S. PATENT DOCUMENTS 5,414,993 A * 5/1995 Kon ..... F01N 13/102 123/193.5
8,146,543 B2 * 4/2012 Kuhlbach ..... F02F 1/243 123/193.5

(Continued)

FOREIGN PATENT DOCUMENTS

DE 3915988 A1 12/1989
DE 102011114771 A1 4/2013
DE 202014100387 U1 2/2014

*Primary Examiner* — Mark A Laurenzi
*Assistant Examiner* — Wesley G Harris
(74) *Attorney, Agent, or Firm* — Julia Voutyras; McCoy Russell LLP

(57) ABSTRACT

Methods and systems are provided for thermally insulating an integrated exhaust manifold for a cylinder head of an applied-ignition, liquid-cooled internal combustion engine. In one example, a method may include regional insulation at a collection point where individual exhaust lines and/or partial exhaust lines merge to form an overall exhaust line within the cylinder head. The regional insulation may be formed integrally with a seal and coupled to an outlet flange of the cylinder head and may include a series of tongue-like projections that extend from the cylinder head outlet flange toward the cylinder exhaust lines.

20 Claims, 4 Drawing Sheets

(51) Int. Cl.

| | |
|---|---|
| ***F02F 1/42*** | (2006.01) |
| ***F02F 11/00*** | (2006.01) |
| ***F01P 3/02*** | (2006.01) |
| ***F02F 1/24*** | (2006.01) |

(56) References Cited

U.S. PATENT DOCUMENTS 8,413,435 B2 * 4/2013 Sloss ..... F01N 13/102
60/313
8,978,615 B2 * 3/2015 Fedotov ..... F02F 11/00
123/196 R

* cited by examiner

APPLIED-IGNITION, LIQUID-COOLED INTERNAL COMBUSTION ENGINE WITH COOLED CYLINDER HEAD

CROSS REFERENCE TO RELATED APPLICATION

The present application claims priority to German Patent Application No. 102016201166.9, filed on Jan. 27, 2016. The entire contents of the above-referenced application are hereby incorporated by reference in its entirety for all purposes.

FIELD

The present description relates generally to methods and systems for a thermally insulated integrated exhaust manifold for an applied-ignition, liquid-cooled internal combustion engine.

BACKGROUND/SUMMARY

In the field of applied-ignition, liquid-cooled internal combustion engines comprising at least one cylinder head with at least two cylinders, it is known that intake lines which lead to the inlet openings, and exhaust lines which adjoin the outlet openings, may be at least partially integrated in the cylinder head. The exhaust lines of the cylinders are generally merged to form one or more overall exhaust lines. The merging of exhaust lines to form an overall exhaust line is referred to generally as an exhaust manifold. It is well known for the exhaust lines of at least two cylinders to at least partially merge within the at least one cylinder head to form an overall exhaust line, thus forming an at least partially integrated exhaust manifold (IEM). It is also well known for a typical liquid-cooled cylinder head to comprise a plurality of coolant ducts or at least one coolant jacket formed in the cylinder head, in order to conduct the coolant through the cylinder head. The resulting cylinder head structure is complex, as well as a thermally and mechanically highly loaded component.

On account of the ever more dense packaging in the engine bay and the increasing integration of parts and components into the cylinder head as mentioned, the thermal loading of the internal combustion engine and of the cylinder head in particular, is increased. As a result, increased demands are placed on the cooling system and it is imperative that measures be taken to reliably prevent thermal overloading of the internal combustion engine.

To reliably prevent overheating of the internal combustion engine, the cooling capacity of the engine cooling arrangement is designed for operating states with a very high cooling demand or the maximum cooling demand, which are characterized by high loads at low vehicle speeds. For example, operating conditions such as those that occur during acceleration and during uphill driving phases. Under such conditions, the engine cooling system is charged with dissipating a very large amount of heat, without the available air flow needed for sufficient heat dissipation.

Attempts to address thermal overloading of individual components of an internal combustion engine with integrated exhaust manifolds include initiating an enrichment (X, <1) whenever high exhaust-gas temperatures are to be expected. Therein, more fuel is injected than can be fully combusted with the provided air quantity, wherein the excess fuel is likewise heated and evaporated, such that the temperature of the combustion gases falls. However, the inventors herein have recognized potential issues with such systems. In one example, this method is generally unable to provide sufficient cooling to the cylinder head. In another example, fuel consumption and pollutant emissions of the internal combustion engine are increased.

Another possible method for improving cooling capacity for a liquid-type cooling arrangement for an internal combustion engine may include constructing the cylinder heads using materials that may be highly loaded thermally, in particular nickel-containing materials. The inventors herein have recognized that highly thermally loadable materials such as these are costly and that by alternately decreasing the thermal loading of the cylinder head, a less costly and lightweight material (e.g., aluminum) may be utilized for cylinder head construction.

Another method for improving cooling capacity for a liquid-type cooling arrangement may lead to excessively large coolers, or multiple coolers, which necessitate mounting in the front-end region of a vehicle where available space is minimal. It is shown that coolers may already be arranged one behind the other and spaced apart from one another so as to partially overlap.

The inventors herein have recognized the shortcomings of attempting to continually increase either cooler size or quantity to address the ever-increasing thermal loading of the cylinder heads and offer an alternate solution. As one example, the inventors herein do not seek to extract the greatest possible amount of heat from the exhaust gas via the cylinder head. Rather, by introducing thermal insulation at least regionally, the heat transferred into the cylinder head is impeded, whereby the cooling power requirements of the engine cooling arrangement is intentionally reduced. The thermal permeability of the heat-transmitting surface, that is to say of the cylinder head wall, is reduced at the exhaust-gas side. Thereby, heat introduced from the exhaust gas to the cylinder head and subsequently to the coolant system occurs to a lesser extent than on an uninsulated system.

One possible method for improving the cooling capacity for an applied-ignition, liquid-cooled internal combustion engine includes utilizing a thermal barrier on the internal walls of the cylinder head to reduce heat transfer to the cylinder head and the coolant system. One example, shown by Kloft et al. in German Patent No. DE 10 2011 114 771 A1 discloses a general process of adhering metal or ceramic insulative coating on the internal walls of the exhaust ports, but it offers little detail on the most suitable arrangement of the insulation within the ports. In another example, shown by Ford Global Technologies LLC in German Patent No. DE 20 2014 100 387 U1, a process is disclosed for insulating the walls of the coolant jackets in a cylinder head. While the Ford patent makes only brief mention of the possibility of insulating the exhaust ports rather than the coolant jackets, they offer no details as to a suitable configuration of exhaust port insulation. In yet another example, shown by Glanz et al. in German Patent No. DE3915988A1, a sheet metal port insert is disclosed to provide a heat insulative layer in the exhaust port. The use of a separate cast insert involves a separate production effort and complex tooling to ensure proper placement during cylinder head casting.

The inventors herein have recognized problems with the above approaches. In one example, integrating complicated insulating inserts into the casting process may be cumbersome and expensive, while in another example, adding regional or full insulation without justification may result in excessive or unneeded insulation and expense. In other examples, utilizing costly materials to withstand the high thermal and mechanical loads on the cylinder head may not be needed if, alternatively, the heat transfer to the head can be reduced. In yet another example, introducing enrichment for the purpose of cooling decreases fuel efficiency and is ineffective. Due to space constraints in the engine bay, increasing cooler size or adding coolers is often not an option to accommodate an increased heat load on the internal combustion engine. Thus, the inventors herein provide an approach to at least partially address the above issues. In one example, an applied-ignition, liquid-cooled internal combustion engine comprising at least one cylinder head with at least two cylinders, in which each cylinder has at least one outlet opening for the discharge of the exhaust gases via an exhaust-gas discharge system, each outlet opening being adjoined by an individual exhaust line and the individual exhaust lines of at least two cylinders merging within the cylinder head at a collection point to form an overall exhaust line thus forming an integrated exhaust manifold, which overall exhaust line emerges from an outlet flange of the cylinder head, and at least one coolant jacket which is integrated in the cylinder head is provided for forming a liquid-type cooling arrangement, and the exhaust manifold integrated in the cylinder head is, at an exhaust-gas side, provided at least regionally with thermal insulation.

In this way, the thermal insulation is formed in such a way as to reduce heat transfer from the exhaust gas to the cylinder head and the consequent burden on the coolant system. As one example, the thermal insulation may comprise a protective heat shield which may comprise a thermal insulation insert having at least one tongue-like element extending into the overall exhaust manifold as well as at least one thermally insulated runner that extends along the interior walls that define the integrated exhaust manifold at the locations of greatest heat load. It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
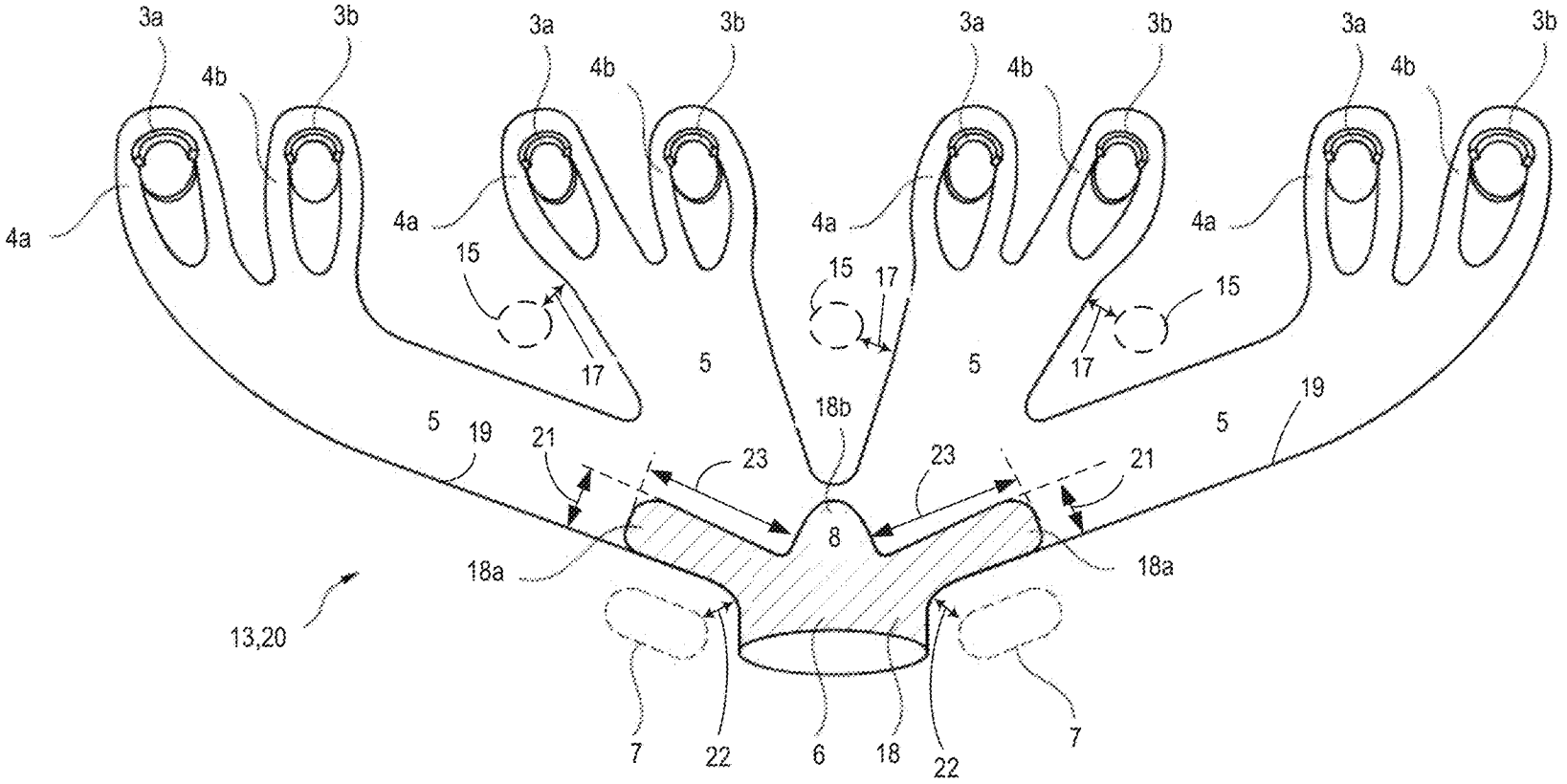
FIG. 1 shows, in a slightly inclined plan view, the sand core of the exhaust gas lines integrated in a first embodiment of the cylinder head.

The disclosure relates to an internal combustion engine, which drives a motor vehicle and, in particular, is an applied-ignition, liquid cooled engine. The internal combustion engine has a cylinder block and at least one cylinder head which are connected to one another at their assembly end sides so as to form the at least two cylinders.

The cylinder head of an internal combustion engine may incorporate coolant ports or coolant jackets as well as integrated exhaust manifolds, in which exhaust lines from at least two cylinders may merge and combine streams within the cylinder head. In this way, the cylinder head becomes a structurally complex component with high thermal and mechanical loads. In a method according to the disclosure, the thermal loads transferred by the high temperature exhaust gases to the cylinder head may be reduced by insulating the exhaust ports in strategic locations—namely in the locations where the individual exhaust lines merge to form an overall exhaust line within the cylinder head. In addition to reducing the burden on the cooling system, insulating the integrated exhaust manifold in this manner offers additional advantages including reducing thermodynamic losses and maintaining elevated temperatures for reaching "warm-up" more quickly, as well as maintaining favorably high exhaust gas temperatures for catalytic after treatment and turbocharging when applicable. By integrating exhaust manifolds into the cylinder head, space requirements may also be minimized. Furthermore, according to the disclosure, the thermal insulation may be formed integrally with a seal, which is provided on a flange formed in the outer wall of the cylinder head. Here, the seal serves for the fastening and fixing of the sleeve-like thermal insulation insert, which acts in the manner of a protective heat shield.

A typical internal combustion engine may be used as a motor vehicle drive unit. Within the context of the present disclosure, the expression "internal combustion engine" encompasses Otto-cycle engines but also applied-ignition hybrid internal combustion engines, which utilize a hybrid combustion process. Another example of an internal combustion engine includes hybrid drives, which comprise the applied-ignition internal combustion engine as well as an electric machine which is drivably connected to the internal combustion engine and which receives power from the internal combustion engine or which, as a switchable auxiliary drive, outputs power.

Internal combustion engines have a cylinder block and at least one cylinder head which are connected to one another at their assembly end sides so as to form the at least two cylinders.

To hold the pistons or the cylinder liners, the cylinder block has a corresponding number of cylinder bores. The pistons are guided in the cylinder liners in an axially movable fashion and form, together with the cylinder liners and the cylinder head, the combustion chambers of the internal combustion engine.

The cylinder head of an applied-ignition, liquid-cooled internal combustion engine conventionally houses the valve drive. To control the charge exchange, an internal combustion engine utilizes control elements and actuating devices for actuating the control elements. During the charge exchange, the combustion gases are discharged via the outlet openings, and the charge of fresh air takes place via the inlet openings. To control the charge exchange, in four-stroke engines, lifting valves are used almost exclusively as control elements. In this way, lifting valves perform an oscillating lifting movement during the operation of the internal combustion engine, which lifts valves to open and close the inlet openings and outlet openings. The valve actuating mechanism responsible for the movement of the valves, including the valves themselves, is referred to as the valve drive.

In applied-ignition internal combustion engines, the appropriate ignition apparatuses may be arranged in the cylinder head, and furthermore in the case of direct-injection internal combustion engines, the injection devices may be arranged in the cylinder head.

To form a suitable connection, that is to say a connection which seals off the combustion chambers, between the cylinder head and cylinder block, an adequate number of adequately large bores shall be provided, which significantly influences the structural design of the at least one cylinder head.

It is fundamentally possible for the engine cooling arrangement to take the form of an air-type cooling arrangement or a liquid-type cooling arrangement. In the case of the air-type cooling arrangement, the internal combustion engine is provided with a fan, wherein the dissipation of heat takes place by means of an air flow conducted over the surface of the cylinder head.

On account of the higher heat capacity of liquids in relation to air, it is possible for significantly greater quantities of heat to be dissipated using a liquid-type cooling arrangement than is possible using an air-type cooling arrangement. For this reason, internal combustion engines are increasingly being equipped with a liquid-type cooling arrangement. Equipping the internal combustion engine according to the disclosure with a liquid-type cooling arrangement includes the provision of coolant ducts which conduct the coolant through the cylinder head, that is to say at least one coolant jacket. Here, the coolant, generally water containing additives or glycol, is delivered by means of a pump arranged in the cooling circuit, such that said coolant circulates in the coolant jacket. The heat that is released to the coolant is thus discharged from the interior of the cylinder head, and is extracted from the coolant again in a heat exchanger which is preferably arranged in the front-end region of a vehicle and which utilizes the relative wind. In this context, the cooler of the liquid cooling arrangement is of particular significance because said cooler is indispensable for reliable operation of the internal combustion engine, and dissipates large amounts of heat.

To provide an adequately large airflow to the heat exchanger of the liquid-type cooling arrangement even when the motor vehicle is at a standstill or in the presence of low vehicle speeds, cooling systems of modern motor vehicle drives are commonly equipped with high-powered fan motors which drive, that is to say set in rotation, a fan impeller.

In this context, it shall also be taken into consideration that the cooler cannot be enlarged to any desired extent, because further heat exchangers, in particular cooling devices, shall generally be provided in order to ensure reliable, fault-free operation of the internal combustion engine or to optimize the operation of the internal combustion engine. An excessively large cooler significantly impedes the other heat exchangers in terms of their arrangement and dimensioning.

Additional examples of heat exchangers will be mentioned and described below in order to illustrate the burden on available cooler space.

The heat released as a result of the combustion of the fuel is dissipated to the walls which define the combustion chamber, to the exhaust-gas flow and possibly to the engine coolant, but also partially to the engine oil. The heat dissipation via the oil pan as a result of heat conduction and natural convection is often insufficient to adhere to the maximum admissible oil temperature, such that an additional oil cooler may be provided.

A charge-air cooler is often arranged on the intake side of an internal combustion engine, which charge-air cooler reduces the temperature of the inducted fresh air or of the inducted fresh mixture and thereby increases the density of the cylinder fresh charge. In this way, the charge-air cooler contributes to favorable charging of the combustion chamber with air or with fresh mixture. Supercharged internal combustion engines are usually equipped with a charge-air cooler.

Aside from the charge-air cooler, internal combustion engines often have further heat exchangers, in particular cooling devices.

Modern internal combustion engines are increasingly commonly being equipped with an exhaust-gas recirculation (EGR) arrangement. Exhaust-gas recirculation, that is to say the recirculation of combustion gases from the exhaust-gas side to the intake side of the internal combustion engine, is considered to be expedient for achieving the aim of adhering to future requirements for pollutant emissions, in particular the requirements for nitrogen oxide emissions. Since the formation of nitrogen oxides occurs at high temperatures, one concept for reducing the nitrogen oxide emissions comprises developing combustion processes, that is to say combustion methods, with lower combustion temperatures, wherein exhaust-gas recirculation is a means for reducing the temperatures.

A considerable reduction in nitrogen oxide emissions occur at high exhaust-gas recirculation rates, which may be of the order of magnitude of $x_{EGR} \approx 50\%$ to 70%. To realize such high recirculation rates, cooling of the exhaust gas to be recirculated, that is to say compression of the exhaust gas by cooling, is imperative in order to increase the density of the recirculated exhaust gas. The internal combustion engine may therefore be equipped with an additional cooling device for cooling the exhaust gas for recirculation.

Further coolers may be provided, for example in order to cool the transmission oil in the case of automatic transmissions and/or to cool hydraulic fluids, in particular hydraulic oil, which is used within hydraulically actuable adjusting devices and/or for steering assistance.

A further heat exchanger is the air-conditioning condenser of an air-conditioning system, which usually operates in accordance with the cold vapor process. The temperature of the air flow supplied to the passenger compartment is reduced as it flows around an evaporator, wherein a coolant flowing though the inside of an evaporator extracts the heat from the air flow and, in so doing, evaporates.

The above statements make it clear that modern internal combustion engines are equipped with a multiplicity of heat exchangers, which, without exception, shall be designed with an adequately large heat-exchanging surface in order to perform their function. In the dimensioning and arrangement of the individual heat exchangers in the front-end region, conflicts often arise owing to the space limitations.

Downstream of the at least one manifold, the exhaust gases are then supplied for example to the turbine of an exhaust-gas turbocharger and/or if appropriate to one or more exhaust-gas aftertreatment systems.

Here, the demands on the cylinder head increase further. In this context, it shall also be taken into consideration that an increasing proportion of internal combustion engines are supercharged—by means of exhaust-gas turbocharger or mechanical charger.

However, the addition of integrated exhaust manifolds into cylinder head that already house coolant ducts or jackets as well as increases the structural complexity and thermal and mechanical loading of the cylinder head, which may be partially addressed by utilizing a highly thermally loadable material (e.g., nickel-based alloy) of construction and/or increasing liquid-cooling capacity. As previously mentioned, the present disclosure offers an alternate solution for mitigating the high thermal loads associated with IEM cylinder heads. Rather than loading the liquid-cooling system with the additional heat dissipation burden of the IEM cylinder head, a portion of the IEM, at least regionally where the individual exhaust lines merge into one overall exhaust line, may be thermally insulated thereby reducing the thermal loading of the cylinder head. This may allow the use of lower cost aluminum cylinder heads and would not affect the size of associated coolers. In the case of applied-ignition, liquid-cooled internal combustion engines in which the at least one cylinder head can be connected at an assembly end side to a cylinder block, one example embodiment is distinguished by the fact that the at least one coolant jacket integrated in the cylinder head has a lower coolant jacket, which is arranged between the exhaust lines and the assembly end side of the cylinder head, and an upper coolant jacket, which is arranged on that side of the exhaust lines which is situated opposite the lower coolant jacket at a distance from the exhaust lines, at least one connection between the lower coolant jacket and the upper coolant jacket is provided in a cylinder head outer wall from which the overall exhaust line is coupled, which connection serves for the passage of coolant, with the at least one crossover connection being arranged adjacent to the region in which the exhaust lines merge to form the overall exhaust line.

It is preferable for at least one crossover connection to be provided in the outer wall of the cylinder head, through which at least one cross over connection coolant can flow from the lower coolant jacket into the upper coolant jacket and vice versa. Therefore, in the cylinder head, at least one crossover connection is arranged on that side of the integrated exhaust manifold which faces away from the at least two cylinders. The at least one connection is therefore situated, as it were, outside the integrated exhaust manifold. Additional crossover connections may be placed between the integrated exhaust manifold and the cylinders to provide supplemental coolant flow.

Firstly, this gives rise to a cooling action in the region of the outer wall of the cylinder head. Secondly, the longitudinal flow of the coolant, that is to say the coolant stream in the direction of the longitudinal axis of the cylinder head, is supplemented by a coolant transverse flow, which runs transversely with respect to the longitudinal flow. Through corresponding dimensioning of the cross section of the at least one crossover connection, it is possible to influence the flow speed of the coolant in the crossover connection, and thus the dissipation of heat in the region of said at least one crossover connection.

Additional cooling of the cylinder head may be achieved by virtue of a pressure gradient being generated between the upper and lower coolant jackets, as a result of which the speed in the at least one crossover connection is in turn increased, which leads to an increased heat transfer as a result of convection.

The present disclosure is for an applied-ignition, liquid-cooled internal combustion engine comprising at least one cylinder head with at least two cylinders, in which each cylinder has at least one outlet opening for the discharge of the exhaust gases via an exhaust-gas discharge system, each outlet opening being adjoined by an individual exhaust line and the individual exhaust lines of at least two cylinders merging within the cylinder head at a collection point to form an overall exhaust line thus forming an integrated exhaust manifold, which overall exhaust line emerges from an outlet flange of the cylinder head, and at least one coolant jacket which is integrated in the cylinder head is provided for forming a liquid-type cooling arrangement, and the exhaust manifold integrated in the cylinder head is, at an exhaust-gas side, provided at least regionally with thermal insulation.

According to the present disclosure, the at least one exhaust manifold integrated in the cylinder head is equipped with thermal insulation, that is to say the walls that delimit the manifold are—at least regionally—provided, that is to say coated, lined or similar, with thermal insulation. In the context of the present disclosure, thermal insulation is distinguished from the material used for producing the cylinder head preferably by the fact that the thermal insulation exhibits lower thermal conductivity than the cylinder head material. In alternate embodiments, thermal insulation may comprise a protective heat shield of enamel, ceramic, metal, or may at least partially be formed by way of surface treatment.

By means of said measure, the amount of heat imperatively to be dissipated is advantageously reduced or restricted. The problem of having to dissipate very large amounts of heat absorbed by the coolant is thus eliminated.

The concept according to the disclosure makes it possible to dispense with thermally highly loadable, in particular nickel-containing materials for the production of the cylinder head, because the cylinder head is firstly equipped with a cooling arrangement, and secondly, the thermal insulation impedes the introduction of heat into the cylinder head, such that materials that can be subjected to lower thermal loads, such as for example aluminum, can be used.

If the at least one cylinder head has two cylinders, the exhaust lines of said two cylinders form an overall exhaust line. If the at least one cylinder head has three or more cylinders, and if the exhaust lines of two cylinders merge to form an overall exhaust line, this is likewise a cylinder head embodiment according to the present disclosure.

Embodiments of the cylinder head in which the cylinder head has, for example, four cylinders in an in-line arrangement and the exhaust lines of the outer cylinders and the exhaust lines of the inner cylinders merge to form in each case one overall exhaust line, are likewise cylinder head embodiments according to the present disclosure.

Embodiments may include three or more cylinders, wherein the at least three cylinders are configured in such a way as to form two groups, each group containing at least one cylinder, and the exhaust lines of the cylinders of each cylinder group merge to form a respective overall exhaust line, thus forming an exhaust manifold. The aforementioned embodiment is suitable in particular for the use of a two-channel turbine, with the two overall exhaust lines being connected to the two-channel turbine in such a way that each overall exhaust line opens into one channel.

However, the grouping of the cylinders or exhaust lines may be suitable for the use of a plurality of turbines or exhaust-gas turbochargers, wherein each overall exhaust line is connected to one turbine.

An alternate embodiment comprises the exhaust lines of all the cylinders of the at least one cylinder head merging to form a single, that is to say common, overall exhaust line.

In one embodiment of the applied-ignition, liquid-cooled internal combustion engine, the overall exhaust line and/or the collecting point may be, at the exhaust-gas side, provided with thermal insulation over more than 50% of their/its extent.

In another embodiment of the applied-ignition, liquid-cooled internal combustion engine, the overall exhaust line and/or the collecting point may be, at the exhaust-gas side, provided with thermal insulation over more than 70% of their/its extent.

In a further embodiment of the applied-ignition, liquid-cooled internal combustion engine, are advantageous in which the overall exhaust line and/or the collecting point may be, at the exhaust-gas side, provided with thermal insulation over more than 80% of their/its extent.

Additionally, an embodiments of the applied-ignition, liquid-cooled internal combustion engine includes the overall exhaust line and/or the collection point, at the exhaust-gas side, is provided with thermal insulation over all of their/its entire extent.

The greater the area over which the thermal insulation is provided, the more intensely the introduction of heat into the cylinder head is impeded, and the greater the extent to which the cooling demand on the liquid-type cooling arrangement is reduced.

The thermal load on a cylinder-specific exhaust line may—in particular at the cylinder side—be high and necessitate thermal insulation according to the disclosure.

Therefore, embodiments of the applied-ignition, liquid-cooled internal combustion engine may also be advantageous in which the exhaust lines of the at least two cylinders are, at the exhaust-gas side, provided with thermal insulation over more than 70% of their extent.

Embodiments of the applied-ignition, liquid-cooled internal combustion engine may include thermal insulation adjoining the outlet openings of the exhaust lines.

In alternate embodiments of the applied-ignition liquid-cooled internal combustion engine, at least one supercharging apparatus may be provided. The concept according to the disclosure is suitable in particular for supercharged internal combustion engines, which, owing to the relatively high exhaust-gas temperatures, are subject to particularly high thermal loading.

In the development of internal combustion engines, it is constantly sought to minimize fuel consumption and reduce pollutant emissions.

One measure for improving the efficiency of an internal combustion engine and/or for reducing the fuel consumption comprises supercharging of the internal combustion engine, wherein supercharging is primarily a method of increasing power, in which the air for the combustion process in the engine is compressed, whereby a greater mass of air can be supplied to each cylinder per working cycle. In this way, the fuel mass and therefore the mean pressure can be increased.

Supercharging is a suitable means for increasing the power of an internal combustion engine while maintaining an unchanged swept volume, or for reducing the swept volume while maintaining the same power. In any case, supercharging leads to an increase in volumetric power output and a more expedient power-to-weight ratio. If the swept volume is reduced, it is thus possible to shift the load collective toward higher loads, at which the specific fuel consumption is lower. By means of supercharging in combination with a suitable transmission configuration, it is also possible to realize so-called downspeeding, with which it is likewise possible to achieve a lower specific fuel consumption.

For supercharging, use is often made of an exhaust-gas turbocharger, in which a compressor and a turbine are arranged on the same shaft. The hot exhaust-gas flow is fed to the turbine and expands in the turbine with a release of energy, as a result of which the shaft is set in rotation. The energy supplied by the exhaust-gas flow to the turbine and ultimately to the shaft is used for driving the compressor which is likewise arranged on the shaft. The compressor conveys and compresses the charge air fed to it, as a result of which supercharging of the cylinders is obtained. A charge-air cooler is advantageously provided in the intake system downstream of the compressor, by means of which charge-air cooler the compressed charge air is cooled before it enters the at least one cylinder. The cooler lowers the temperature and thereby increases the density of the charge air, such that the cooler also contributes to favorable charging of the cylinders, that is to say to a greater air mass. Compression by cooling takes place.

One advantage of an exhaust-gas turbocharger in relation to a mechanical supercharger is that an exhaust-gas turbocharger utilizes the exhaust-gas energy of the hot exhaust gases, whereas a mechanical supercharger draws the energy for driving it directly or indirectly from the internal combustion engine. In general, there exists a mechanical or kinematic connection for the transmission of power between the supercharger and the internal combustion engine.

One advantage of a mechanical supercharger, that is to say a supercharging blower in relation to an exhaust-gas turbocharger is that the mechanical supercharger generates, and makes available, the charge pressure at all times, specifically regardless of the operating state of the internal combustion engine, in particular regardless of the present rotational speed of the crankshaft. This applies in particular to a mechanical supercharger which can be driven by way of an electric machine.

It is known that difficulties are encountered in achieving an increase in power in all engine speed ranges by means of exhaust-gas turbocharging. A relatively severe torque drop is observed in the event of a certain engine speed being undershot. Said torque drop is understandable if one takes into consideration that the charge pressure ratio is dependent on the turbine pressure ratio. If the engine speed is reduced, this leads to a smaller exhaust-gas mass flow and therefore to a lower turbine pressure ratio. Consequently, toward lower engine speeds, the charge pressure ratio likewise decreases. This equates to a torque drop.

It is possible, using a variety of measures, to improve the torque characteristic of a supercharged internal combustion engine.

One such measure, for example, is a small design of the turbine cross section and a provision for an exhaust-gas blow-off facility. Such a turbine is also referred to as a wastegate turbine. If the exhaust-gas mass flow exceeds a predetermined value, a part of the exhaust-gas flow is, within the course of the so-called exhaust-gas blow-off, conducted via a bypass line past the turbine. This approach has the disadvantage that the supercharging behavior is inadequate at relatively high rotational speeds or in the case of relatively high exhaust-gas quantities.

The torque characteristic may also be increased by means of multiple turbochargers arranged in parallel, that is to say by means of multiple turbines of relatively small turbine cross section arranged in parallel, wherein turbines are activated successively with increasing exhaust-gas flow rate.

The torque characteristic of a supercharged internal combustion engine may furthermore be advantageously influenced by means of a plurality of exhaust-gas turbochargers connected in series. By connecting two exhaust-gas turbochargers in series, of which one exhaust-gas turbocharger serves as a high-pressure stage and one exhaust-gas turbocharger serves as a low-pressure stage, the compressor characteristic map can advantageously be expanded, specifically both in the direction of smaller compressor flows and also in the direction of larger compressor flows. In particular, with the exhaust-gas turbocharger which serves as a high-pressure stage, it is possible for the surge limit to be shifted in the direction of smaller compressor flows, as a result of which high charge pressure ratios can be obtained even with small compressor flows, which considerably improves the torque characteristic in the lower engine speed range.

For the reasons stated above, embodiments of the applied-ignition, liquid-cooled internal combustion engine may include a supercharging apparatus, wherein at least one exhaust-gas turbocharger is provided which comprises a turbine arranged in the exhaust-gas discharge system and a compressor arranged in the intake system, the turbine and the compressor being arranged on the same rotatable shaft, and the overall exhaust line of the exhaust manifold opening into the turbine.

Embodiments of the disclosure are suitable for use with an internal combustion engine in which an exhaust-gas turbocharging arrangement is provided. In this embodiment, the overall exhaust line and the turbine may be connected to one another in non-positively locking fashion via a flange connection and with the use of a seal arranged in a sealing surface.

It is sought to arrange the turbine as close as possible to the outlet of the cylinders in order to be able to optimally utilize the exhaust-gas enthalpy of the hot exhaust gases, which is determined significantly by the exhaust-gas pressure and the exhaust-gas temperature, and to ensure a fast response behavior of the turbine or of the turbocharger. Furthermore, in this way, the path for the hot exhaust gases to the various exhaust-gas aftertreatment systems is also shortened.

A gas-tight connection at this location, which can be subjected to high thermal load, shall be formed between the cylinder head and the turbine in order to eliminate the risk of exhaust gas escaping into the surroundings as a result of leakage.

In this context, the embodiment of the applied-ignition, liquid-cooled internal combustion engine in which the thermal insulation is formed integrally with the seal is highly suitable. The seal then also serves, in effect, for the fastening or fixing of the thermal insulation. Here, the thermal insulation may also be of sleeve-like or flower-like form with multiple petals or tongues and with a connecting ring-shaped element.

In one embodiment of the applied-ignition, liquid-cooled internal combustion engine, the thermal insulation is formed at least regionally in the manner of a protective shield.

In a further embodiment of the applied-ignition, liquid-cooled internal combustion the thermal insulation formed in the manner of a protective shield has at least one tongue-like element (e.g. petal).

In numerous embodiments of the applied-ignition, liquid-cooled internal combustion engine, the thermal insulation may comprise a protective heat shield of enamel, ceramic, metal, or may at least partially be formed by way of surface treatment.

To form the protective heat shield, it is also possible for material, for example enamel or ceramic or the like, to be initially introduced and subsequently subjected to surface treatment. If appropriate, the thermal insulation is formed exclusively by surface treatment.

Embodiments of the applied-ignition, liquid-cooled internal combustion engine may include each cylinder having two or three outlet openings for discharging the exhaust gases out of the cylinder.

It is the object of the valve drive to open and close the inlet and outlet openings of the combustion chamber at the correct times, with a fast opening of the greatest possible flow cross sections being sought in order to keep the throttling losses in the inflowing and outflowing gas flows low and in order to ensure the most suitable charging of the combustion chamber with fresh mixture, and an effective, that is to say total discharge of the exhaust gases. In this manner, the cylinders may be provided with two or more outlet openings.

Illustrative embodiments of a thermally insulated integrated exhaust manifold in the cylinder head of an applied-ignition, liquid-cooled internal combustion engine are shown in FIGS. 1-4, wherein the protective heat shield coupled to the integrated exhaust manifold is suitable for carrying out one or more methods according to the disclosure.

FIG. 1 shows, in a slightly inclined plan view, a sand core of exhaust gas lines integrated in a first embodiment of a cylinder head.

Figure 2:
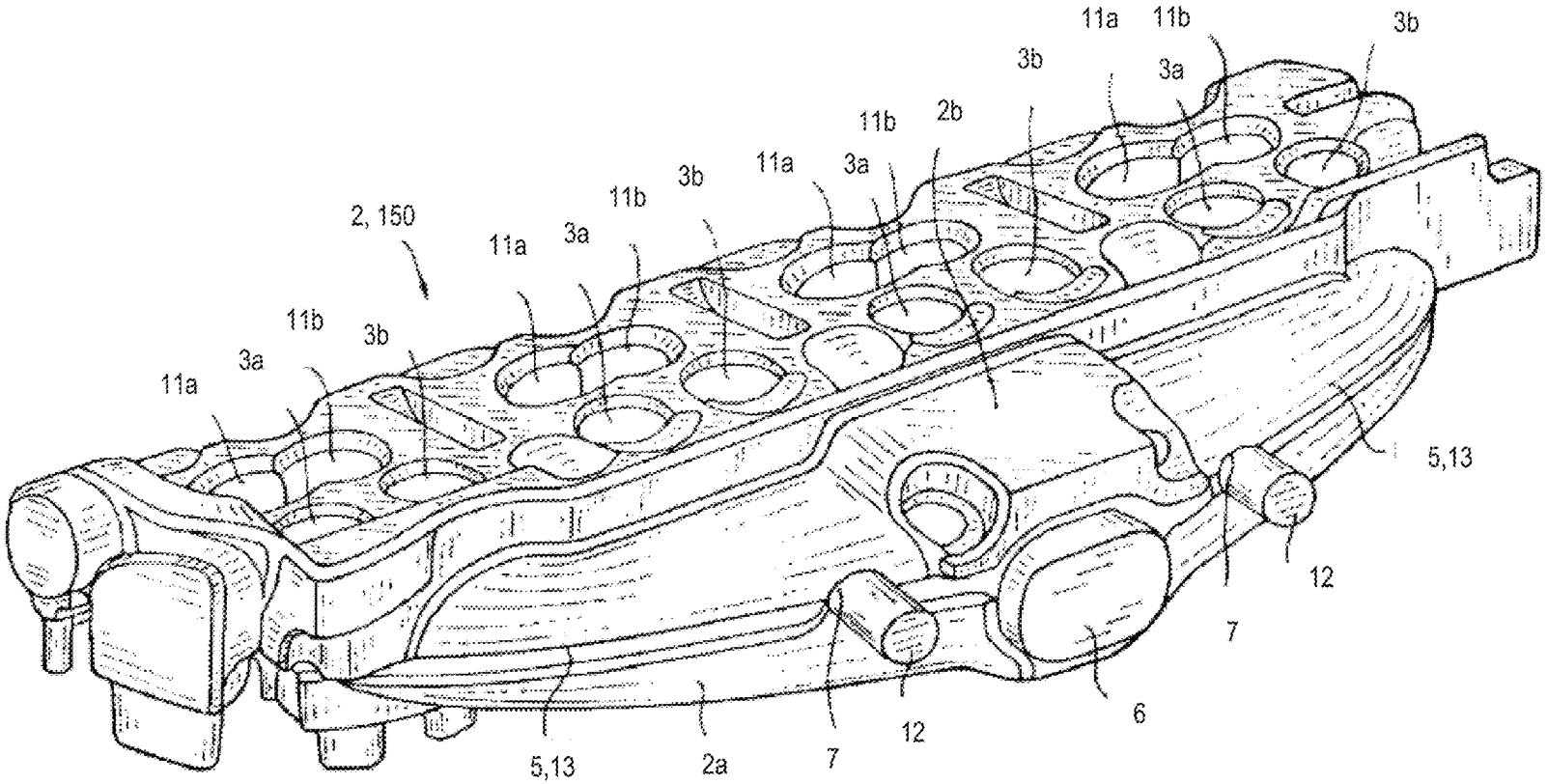
FIG. 2 shows, in a perspective illustration, the sand core illustrated in FIG. 1 together with the coolant jacket of the first embodiment of the cylinder head.

FIG. 2 shows, in a perspective illustration, the sand core illustrated in FIG. 1 together with a sand core of a coolant jacket of the first embodiment of the cylinder head.

Figure 3:
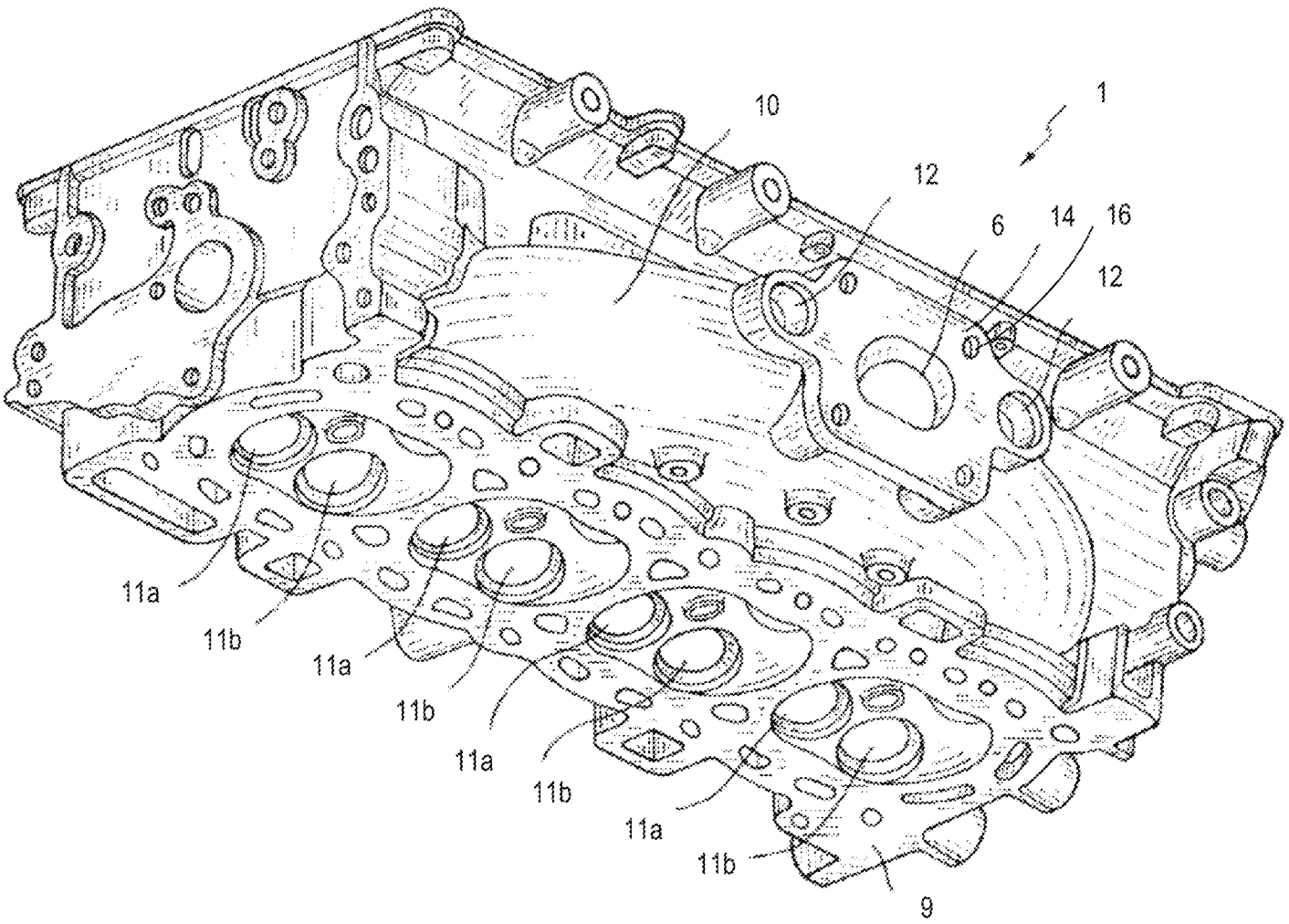
FIG. 3 shows a perspective illustration of the first embodiment of the cylinder head.

FIG. 3 shows, in a slightly inclined bottom plan view, the first embodiment of the cylinder head.

Figure 4:
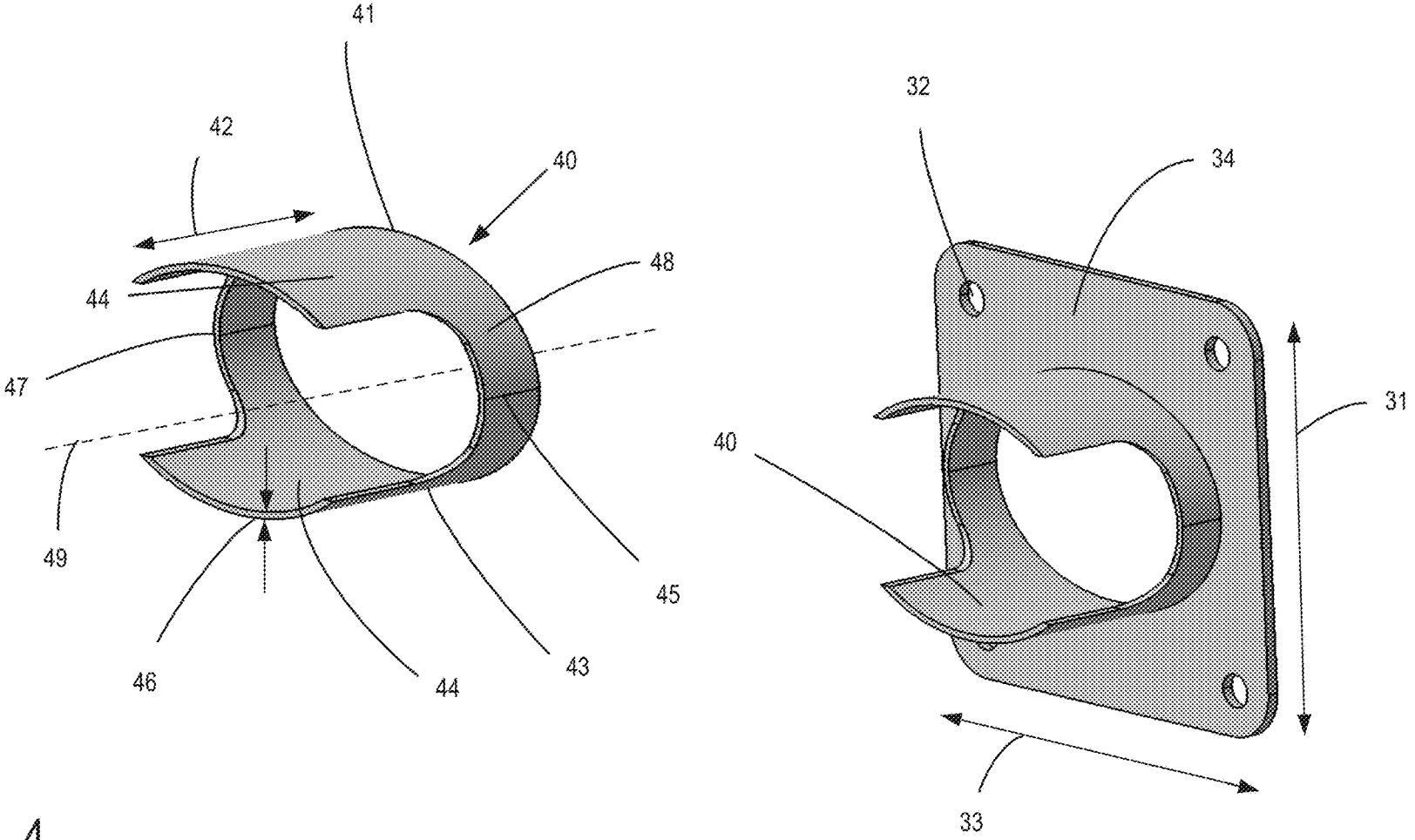
FIG. 4 shows a first embodiment of the thermal insulation insert.

FIG. 4 shows an embodiment of a thermal insulation insert with integrated seal.

FIGS. 1-4 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

A sand core 13 of an integrated exhaust manifold 20 is shown in FIG. 1. As will be understood by persons of skill in the art, integrated exhaust manifold 20 is actually an empty void present in a finished cylinder head 1. That is, integrated exhaust manifold 20, as depicted by the sand core 13 in FIG. 1 is the core, commonly made of sand, used in a casting process used to manufacture cylinder head 1. When the core is removed from the cylinder head 1 after the casting has solidified, the remaining void constitutes the integrated exhaust manifold 20 through which exhaust gas flows during operation of the engine.

As used herein, the integrated exhaust manifold 20 as shown in FIG. 1 comprises the merging of individual exhaust lines 4*a*, 4*b* (as known herein as exhaust lines, exhaust ports or cylinder ports) from at least two cylinders within the at least one cylinder head 1 to form an overall exhaust line 6, thus forming an integrated exhaust manifold 20. Individual exhaust lines 4*a*, 4*b* may merge into at least one partial exhaust lines 5, wherein the at least one partial exhaust lines 5 may merge to form the overall exhaust line 6. The integrated exhaust manifold 20 illustrated in FIG. 1 comprises a plurality of individual exhaust lines 4*a* and 4*b*, partial exhaust lines 5 and an overall exhaust line 6 of a cylinder head 1 of a four-stroke internal combustion engine although alternate embodiments may include engines with more or less cylinders. Each of the four cylinders is equipped with two outlet openings 3*a*, 3*b*, with first and second exhaust lines 4*a* and 4*b* adjoining each outlet opening 3*a*, 3*b*, respectively. The location where the plurality of exhaust lines 4*a*, 4*b*, and 5 combine into the overall exhaust line 6 shall be known as the collection point 8.

FIG. 2 shows, in a perspective illustration, the sand core 13 of the integrated exhaust manifold 20 illustrated in FIG. 1 together with a sand core 150 of a coolant jacket 2 of the first embodiment of the cylinder head 1. As will be understood by persons of skill in the art, coolant jacket 2 is actually an empty void present in the finished cylinder head 1. That is, sand core 150 as depicted in FIG. 2 is the core, commonly made of sand, used in a casting process used to manufacture cylinder head 1. When the core is removed from the cylinder head 1 after the casting has solidified, the remaining void constitutes the coolant jacket 2 through which cooling fluid circulates during operation of the engine (not shown).

The coolant jacket 2 comprises a lower coolant jacket 2*a*, which is arranged between the partial exhaust lines 5 and an assembly end-side 9 of the cylinder head 1 (see FIG. 3), and an upper coolant jacket 2*b*, which is arranged on that side of the partial exhaust lines 5 which is situated opposite the lower coolant jacket 2*a*. The lower and the upper coolant jackets 2*a*, 2*b* are not connected to one another over the entire region of an outer wall 10, but rather over a partial region of the outer wall 10, specifically adjacent to the overall exhaust line 6.

The first and second exhaust lines 4*a*, 4*b* of each cylinder merge to form a partial exhaust line 5, which is associated with the cylinder, with the partial exhaust lines 5 subsequently, that is to say downstream, merging in turn to form the overall exhaust line 6. At least one cylinder-side connection 15 between the lower coolant jacket 2*a* and the upper coolant jacket 2*b* may be provided (illustrated as dash-dotted circles in FIG. 1) between the partial exhaust lines 5 of two adjacent cylinders—at a distance 17 from said partial exhaust lines 5. The distance 17 may vary for each cylinder-side connection or may be the same.

The cylinder-side connections 15 assist the cooling of a thermally highly loaded collection point 8 at which the exhaust gas flows of all the cylinders merge, that is to say are collected. All the exhaust gas of the internal combustion engine passes said collection point 8, that is to say that the collection point 8 of the partial exhaust lines 5 is where the partial exhaust lines 5 open out into the overall exhaust line 6. Two outer wall crossover connections 7 between the lower coolant jacket 2*a* and the upper coolant jacket 2*b* are provided adjacent to the outer wall 10 of the cylinder head 1, from which the overall exhaust line 6 is coupled. The outer wall crossover connections 7 in turn serve for the passage of coolant (illustrated as dash-dotted ellipses in FIG. 1). The outer wall crossover connections 7 are arranged adjacent to the overall exhaust line 6, that is to say to the collection point 8 in which the exhaust lines 4*a*, 4*b*, and 5 merge to form the overall exhaust line 6. Because this is the location where the greatest amount of head load exists in the integrated exhaust manifold 20, it is most imperative that the protective heat shield 18 is positioned here to minimize the amount of exhaust heat transferred into the cylinder head 1 and consequently into the liquid cooling system.

The two outer wall crossover connections 7 are therefore arranged adjacent to the region in which the partial exhaust lines 5 merge to form the overall exhaust line 6, at a distance 22 from the overall exhaust line 6 as shown in FIG. 1. As used herein, adjacent means between the outer wall 10 of the cylinder head 1 and the integrated exhaust manifold 20 within a threshold distance 22 from the overall exhaust line, the distance 22 not to exceed 10 cm. The distance 22 shall be maintained to ensure the most efficient heat transfer near the overall exhaust line 6 and may vary for each crossover connection or may be the same. All of the exhaust gas of the internal combustion engine flows through the collection point 8, which is continuously subjected to hot exhaust gases, whereas the partial exhaust lines 5 of a cylinder are temporarily traversed by hot exhaust gas. In addition, the exhaust-gas flows are deflected in the region of the collection point 8, adding to heat transfer loads in the collection point 8. The two outer wall 10 crossover connections 7 permit cooling even in the region of the outer wall 10 of the cylinder head 1, with the longitudinal flows—in the direction of the longitudinal axis of the cylinder head 1, which are generated in the upper and lower coolant jackets 2*a*, 2*b*, being enhanced by two coolant flows which run transversely with respect to the longitudinal flows.

In order to remove the sand core 13 after the casting of the cylinder head 1, at least one access opening 12 is provided in the region of the overall exhaust line 6 or of the outer wall crossover connections 7, which access openings 12 are closed off after the removal of the sand core 13. It can also be seen that each cylinder has two outlet openings 3*a*, 3*b* as well as two inlet openings 11*a*, 11*b*. FIG. 3 shows a perspective illustration of the first embodiment of the cylinder head 1, specifically from below, that is to say with a view of the assembly end-side 9 and the inlet openings 11*a*, 11*b* of the cylinders.

It is possible to see the outwardly projecting outer wall 10 in which the outlet of the overall exhaust line 6 out of the cylinder head 1 is centrally arranged, with a cylinder head 1 outlet flange 14 being provided, to which cylinder head 1 outlet flange 14 may be fastened an external exhaust passage (not shown) or to a turbine (not shown) for discharging the exhaust gases out of the cylinder head 1.

The cylinder head 1 is subjected to particularly high thermal load in the region in which the partial exhaust lines 5 open into the overall exhaust line 6 and in which the hot exhaust gas from the cylinders of the internal combustion engine is collected, and in the region of the overall exhaust line 6 itself. There are numerous reasons for this.

Firstly, all of the exhaust gas of the internal combustion engine passes through the collection point 8 and the overall exhaust line 6, whereas an individual exhaust line 4*a*, 4*b* which adjoins the outlet openings 3*a*, 3*b* of a cylinder is charged with the exhaust gas or some of the exhaust gas of one cylinder. That is to say, the absolute flow rate of exhaust gas that releases or can release heat to the cylinder head 1 is greater.

Secondly, the region in which the partial exhaust lines 5 open into the overall exhaust line 6, and the overall exhaust line 6 itself, are charged with hot exhaust gas continuously, whereas the exhaust lines 4*a*, 4*b* of a cylinder—for example in the case of a four-stroke internal combustion engine—are flowed through by hot exhaust gas during the charge exchange of the respective cylinder, that is to say once per two crankshaft rotations.

It shall be noted that, in the inflow region to the overall exhaust line 6, that is to say in the region of the collection point 8, the exhaust-gas flows of the partial exhaust lines 5 are diverted to a greater or lesser extent in order to be able to merge the exhaust lines to form the overall exhaust line 6. Therefore, in said region, the individual exhaust-gas flows—at least partially—have a speed component perpendicular to an outer interior wall 19 of the overall exhaust line 6 or of the integrated exhaust manifold 20, that is to say the outer interior wall 19 is the interior wall of the exhaust lines 5 and 6 which is positioned away from the cylinders. As a result, the heat transfer by convection and consequently the thermal loading of the cylinder head 1 are additionally increased in this region. At least one thermally insulated runner 18*a* may comprise a straight length 23 in order to thermally insulate a sufficient portion of outer interior wall 19 where the heat load is the greatest. The thermally insulated runners 18*a* may have a width 21, that is to say that width 21 may extend to cover an upper and lower surface of the outer interior wall 19 in addition to the vertical surface of the outer interior wall 19.

For the stated reasons, a protective heat shield 18 at the location of the overall exhaust line 6 and the collection point 8 of the integrated exhaust manifold 20 in the cylinder head 1 offers an efficient and effective means for reducing the heat transfer at the areas most affected.

In one embodiment, thermal insulation of the overall exhaust line 6 may be achieved by a protective heat shield 18, wherein the protective heat shield 18 may be formed as an insert, a casted component, surface treatment, or some combination thereof as shown in FIG. 1. In another embodiment, the protective heat shield 18 may be a multi-piece configuration wherein a thermal insulation insert 40 with at least one tongue-like projection 44 extends a length 42 into the overall exhaust line 6 from the outlet flange 14 of the cylinder head 1 forming at least one thermally insulated region 18*b* adjacent to the collection point 8.

The thermal insulation insert 40 comprises a narrow cylindrical sleeve 48, which includes a top surface 41, bottom surface 43, a first side surface 45, and a second side surface 47 wherein the top and bottom surfaces 41 and 43 include a tongue-like projection 44 of length 42 as shown in FIG. 4. When the thermal insulation insert 40 is coupled to the overall exhaust line 6, the cylindrical sleeve 48 serves to thermally insulate the overall exhaust line 6, but may not extend in such a manner as to impede exhaust flow. Thus, having tongue-like projections 44 along the top and bottom surfaces of the overall exhaust line 6, incoming side flow from partial exhaust lines 5 is not impeded. In this embodiment, the tongue-like projections 44 may be located on the top and bottom surfaces of the thermal insulation insert, but more or less tongue-like projections 44 may be used.

Upon placement, the thermal insulation insert 40 mates with at least one thermally insulated runner 18*a* coupled to the outer wall 19 of the integrated exhaust manifold 20. The at least one thermally insulated runner 18*a* may extend farther into the partial exhaust lines 5 than the insulated regions 18*b* created by the tongue-like projections 44. It shall be noted that the top insulated region 18*b* is shown in FIG. 1; the corresponding bottom insulated region 18*b* is not shown in FIG. 1. It shall be noted that the embodiment shown in FIG. 1 is of an integral protective heat shield 18, but multiple embodiments are possible. The tongue-like projections 44 extend inward from the cylinder head 1 outlet flange 14, that is to say, from the outlet flange 14 of the cylinder head 1 toward the center of the cylinder head 1. The tongue-like projections 44 may be in face-sharing contact with the overall exhaust line 6 with no airgap there-between. The coupling of the thermal insulation insert 40 with the overall exhaust line 6 in this manner will not impede exhaust gas flow. In addition, the thickness 46 of the thermal insulation insert 40 is such that it will not impede exhaust gas flow. This embodiment comprises two thermally insulated runners 18*a* but more or less thermally insulated runners 18*a* may be used.

The thermal insulation insert 40 may be formed integrally with a seal 34 (e.g., gasket). The seal 34 may be formed integrally with a cylindrical sleeve 48 of the thermal insulation insert 40 in a perpendicular orientation. That is to say, an axis 49 which passes through the center of the cylindrical sleeve 48 is perpendicular to a plane parallel with the surface of the cylinder head 1 outlet flange 14 and seal 34. In alternate embodiments, the cylindrical sleeve 48 may be elliptical or another appropriate shape to accommodate the overall exhaust line 6 and cylinder head 1 configuration. The seal 34 is provided on the cylinder head 1 outlet flange 14 and is mountably fixed using a plurality of fasteners (not shown) that pass through a plurality of fastener apertures 16 in the outlet flange 14 as well as a plurality of corresponding fastener apertures 32 in the seal 34. In this embodiment, four fasteners (not shown) and sets of four apertures each in the outlet flange 14 and seal 34 are thus represented. In alternate embodiments, a different number of fasteners may be used. Here, the seal 34 serves for the fastening and fixing of the insert thermal insulation insert 40, which acts in the manner of the protective heat shield 18 (illustrated as a hatched area in FIG. 1). The seal 34 has a height 31 and a width 33 that are sufficiently large to cover the outlet flange 14 and provide an airtight attachment between the cylinder head 1 and an attached device. Examples of attached devices may include, but are not limited to, external exhaust passages and turbochargers. Individual cylinder head and port configuration may dictate the specific length and width of the protective heat shield 18 design. As previously stated, the protective heat shield 18 may be in the form of a cast insulating material, a surface treatment, a metal or ceramic insert, or another appropriate method of insulation.

As previously stated, all of the exhaust gas originating from the cylinders passes through the collection point 8, at which the partial exhaust lines 5 merge and open into the overall exhaust line 6, that is to say the mouth region where the exhaust gas of all of the cylinders is collected. In one embodiment, the protective heat shield 18 is formed integrally with the seal 34.

By the provision of the protective heat shield 18, the introduction of heat from the exhaust gas into the cylinder head 1 and into the coolant is impeded, whereby it is achieved both that less heat is extracted from the exhaust gas and also that less heat is introduced into the coolant. The cooling demands are targetedly reduced by the strategic placement of the protective heat shield 18 in that the thermal permeability of the heat-transmitting wall is reduced. It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An applied-ignition, liquid-cooled internal combustion engine comprising at least one cylinder head with at least two cylinders, in which each cylinder has at least one outlet opening for discharge of exhaust gases via an exhaust-gas discharge system, each outlet opening being adjoined by an individual exhaust line and individual exhaust lines of the at least two cylinders merging within the cylinder head at a collection point to form an overall exhaust line, the overall exhaust line connects with an outlet flange of the cylinder head, and at least one coolant jacket integrated within the cylinder head, and thermal insulation with at least one tongue-like projection and formed integrally with a seal and extending from the outlet flange of the cylinder head to the collection point.

2. The applied-ignition, liquid-cooled internal combustion engine as claimed in claim 1, wherein the overall exhaust line and the collection point are provided with thermal insulation.

3. The applied-ignition, liquid-cooled internal combustion engine of claim 1, wherein the individual exhaust lines are provided with thermal insulation.

4. The applied-ignition, liquid-cooled internal combustion engine of claim 1, further comprising a lower coolant jacket arranged between the individual exhaust lines and a side of the cylinder head connectable to a cylinder block, and an upper coolant jacket arranged on an opposite side of the individual exhaust lines.

5. The applied-ignition, liquid-cooled internal combustion engine of claim 1, wherein thermal insulation comprises a heat shield with a seal connected to the outlet flange and the heat shield mating with thermal insulation of at least one individual exhaust line.

6. A system, comprising:

a cylinder head with integrated exhaust lines merging at a collection point forming an overall exhaust line;

an upper coolant jacket and a lower coolant jacket each integrated in the cylinder head; and a protective heat shield positioned within the overall exhaust line and having a same cross sectional shape as the overall exhaust line, the protective heat shield including at least one tongue-like projection formed by at least one cut out in one or more directions of at least one individual exhaust line.

7. The system of claim 6, wherein the cylinder head includes at least two cylinders, each cylinder having at least one exhaust outlet adjoined by at least one individual exhaust line and individual exhaust lines of the at least two cylinders merge to form at least two partial exhaust lines; the at least two partial exhaust lines merging within the cylinder head to form the integrated exhaust lines.

8. The system of claim 7, wherein the protective heat shield comprises at least one thermally insulated runner along an outer wall.

9. The system of claim 7, wherein the upper and lower coolant jackets are fluidically connected via crossover passages, the crossover passages located adjacent to at least one partial exhaust line.

10. The system of claim 6, wherein the protective heat shield comprises a first tongue-like projection on a top surface of the protective heat shield and a second tongue-like projection on a bottom surface of the protective heat shield.

11. The system of claim 6, wherein at least one thermally insulated runner comprises one or more of a mechanically placed insert, a casting in the cylinder head, and a treated surface of the cylinder head.

12. The system of claim 6, wherein the lower coolant jacket is positioned between the integrated exhaust lines and a side of the cylinder head connected to a cylinder block, and the upper coolant jacket is positioned on an opposing side of the integrated exhaust lines, the upper and lower coolant jackets being fluidically connected via crossover passages, the crossover passages located adjacent to the overall exhaust line.

13. The system of claim 6, wherein the protective heat shield comprises one or more of a mechanically placed insert, a casting in the cylinder head, and a treated surface of the cylinder head.

14. The system of claim 6, wherein the protective heat shield is coupled adjacent to an outlet flange of the cylinder head and is in face-sharing contact with internal walls that define the overall exhaust line with no air gap there-between.

15. The system of claim 6, wherein crossover passages between the upper and lower cooling jackets and the protective heat shield are located adjacent to the collection point.

16. A system comprising:

at least one cylinder head with at least two cylinders, in which each cylinder has at least one exhaust outlet adjoined by at least one individual exhaust line and individual exhaust lines of the at least two cylinders merge within the cylinder head at a collection point to form an overall exhaust line, in which the overall exhaust line is coupled to an outlet flange of the cylinder head;

at least two coolant jackets integrated in the cylinder head; and a protective heat shield comprising a thermal insulation insert with at least one tongue-like projection and formed integrally with a seal coupled to the outlet flange of the cylinder head.

17. The system of claim 16, wherein the thermal insulation insert formed integrally with the seal comprises a cylindrical sleeve to which the at least one tongue-like projection is attached, the cylindrical sleeve being perpendicularly fixed to the seal that is coupled to the outlet flange, wherein the seal includes a plurality of fastener apertures.

18. The system of claim 16, wherein the overall exhaust line is connected to an external exhaust passage via the outlet flange and the seal.

19. The system of claim 16, wherein the at least one tongue-like projection extends along a top surface and a bottom surface and mates with thermal insulation of at least one individual exhaust line.

20. The system of claim 16, wherein at least one cut out in the protective heat shield forms the at least one tongue-like projection and the at least one cut out is in a direction of an exhaust flow of at least one individual exhaust line positioned to a side of the overall exhaust line.

* * * * *